US005394961A

United States Patent [19]

Biver

[11] Patent Number: 5,394,961

[45] Date of Patent: Mar. 7, 1995

[54] SAFETY EDGE ASSEMBLY FOR ELEVATOR DOORWAYS

[75] Inventor: William R. Biver, Dubuque, Iowa

[73] Assignee: Montgomery Elevator Company, Moline, Ill.

[21] Appl. No.: 52,516

[22] Filed: Apr. 29, 1993

[51] Int. Cl.[6] ..... B66B 13/26

[52] U.S. Cl. ..... 187/317; 187/333; 187/313; 49/118

[58] Field of Search ..... 187/103, 104, 51, 1 R, 187/132, 56, 130, 131, DIG. 1; 49/120, 118, 117

[56] References Cited

U.S. PATENT DOCUMENTS

| | | | |
|---|---|---|---|
| 3,370,677 | 2/1968 | Federmann et al. | 187/103 |
| 3,834,081 | 9/1974 | Catlett | 49/360 |
| 4,785,143 | 11/1988 | Miller | 200/61.43 |
| 5,074,773 | 12/1991 | Tischler | 425/134 |
| 5,149,921 | 9/1992 | Picado | 187/130 |

*Primary Examiner*—Steven L. Stephan
*Assistant Examiner*—Robert Nappi
*Attorney, Agent, or Firm*—Wood, Phillips, VanSanten, Clark & Mortimer

[57] ABSTRACT

A safety edge assembly is provided for an electronic sensor system in an elevator doorway. A narrow elongated transmitter frame mounts appropriate electronic transmitting components of the system thereon and is fastened vertically on one side of the doorway. A narrow elongated receiver frame mounts appropriate electronic receiver components of the system thereon and is fastened vertically on the opposite side of the doorway. A power supply frame mounts appropriate electronic power components of the system thereon and is fastened in a piggyback fashion on the transmitter frame. Electrical cables are coupled between the electronic components on opposite sides of the doorway, the cables extending across the top of the doorway.

14 Claims, 5 Drawing Sheets

SAFETY EDGE ASSEMBLY FOR ELEVATOR DOORWAYS

FIELD OF THE INVENTION

This invention generally relates to the art of passenger conveyors, such as elevators, and particularly to a safety edge assembly for an electronic sensor system in an elevator doorway.

BACKGROUND OF THE INVENTION

Most elevator systems, particularly those provided primary as passenger conveyors, are required to have some form of safety sensor system which senses the presence of an object, such as a person, in the doorway of the elevator to signal a door or doors not to close. Most such sensors are electronic light-responsive sensors which sense a light path being broken, such as by a passenger entering or exiting the elevator car or cab.

Most such electronic sensor systems include three basic components, namely a power supply, a transmitter and a receiver. The transmitter and the receiver are mounted in housings on opposite sides of the elevator doorway. Heretofore, these basic components have created problems because they are of rather complicated and expensive constructions. They include fasteners, brackets and numerous other mounting devices for the electrical mechanisms, which are difficult to assemble and prone to damage and loosening in a high vibration environment. In addition, it has been prevalent to mount the power supply and its housing or frame above the doorway where it can interfere with other components of the elevator system. It always has been undesirable to run high power lines and to mount high power components on top of the elevator doorway.

This invention is directed to solving the above problems in a safety edge assembly which is very compact, easy to manufacture, very cost effective and obviates mounting any components other than wiring above the elevator doorway.

SUMMARY OF THE INVENTION

An object, therefore, of the invention is to provide a new and improved safety edge assembly for an electronic sensor system in an elevator doorway.

In the exemplary embodiment of the invention, the assembly includes a narrow elongated transmitter frame for mounting appropriate electronic transmitting components of the system thereon. Means are provided for fastening the transmitter frame vertically on one side of the doorway. A narrow elongated receiver frame mounts appropriate electronic receiver components of the system thereon, and means are provided for fastening the receiver frame vertically on the opposite side of the doorway. A power supply frame mounts appropriate electronic power supply components of the system thereon, and means are provided for fastening the power supply frame in a piggyback fashion on the transmitter frame. Low power, electrical cable means are coupled between the electronic components on opposite sides of the doorway and extend across the top of the doorway. The cable means are provided herein by a pair of flexible electrical cables interconnected above the doorway by a pair of electrical connectors terminated to the cables.

In the preferred embodiment of the invention, the narrow elongated transmitter and receiver frames are generally channel-shaped in cross-section, whereby each frame defines a pair of side leg portions joined by a bight portion providing a cavity for mounting the appropriate electronic components therewithin. Preferably, both the transmitter and receiver frames are formed as extruded members of identical construction. The fastening means for the frame include a dove-tail slot running lengthwise of each frame on the outside of the bight portion thereof for receiving the heads of the appropriate headed fasteners. Mounting means are extruded integral with the inside of the leg means of the frames for mounting the appropriate electronic components, such as printed circuit boards, spanning the leg portions. An elongated cover is adapted for mounting on the frames for closing the elongated cavity provided thereby.

The power supply frame also is disclosed as a channel-shaped member with a bight portion adapted to be mounted to the bight portion of one of the transmitter and receiver frames. The channel-shaped power supply frame includes a pair of side leg portions having mounting means on the inside thereof for mounting an electronic component, such as a printed circuit board, spanning the leg portions.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
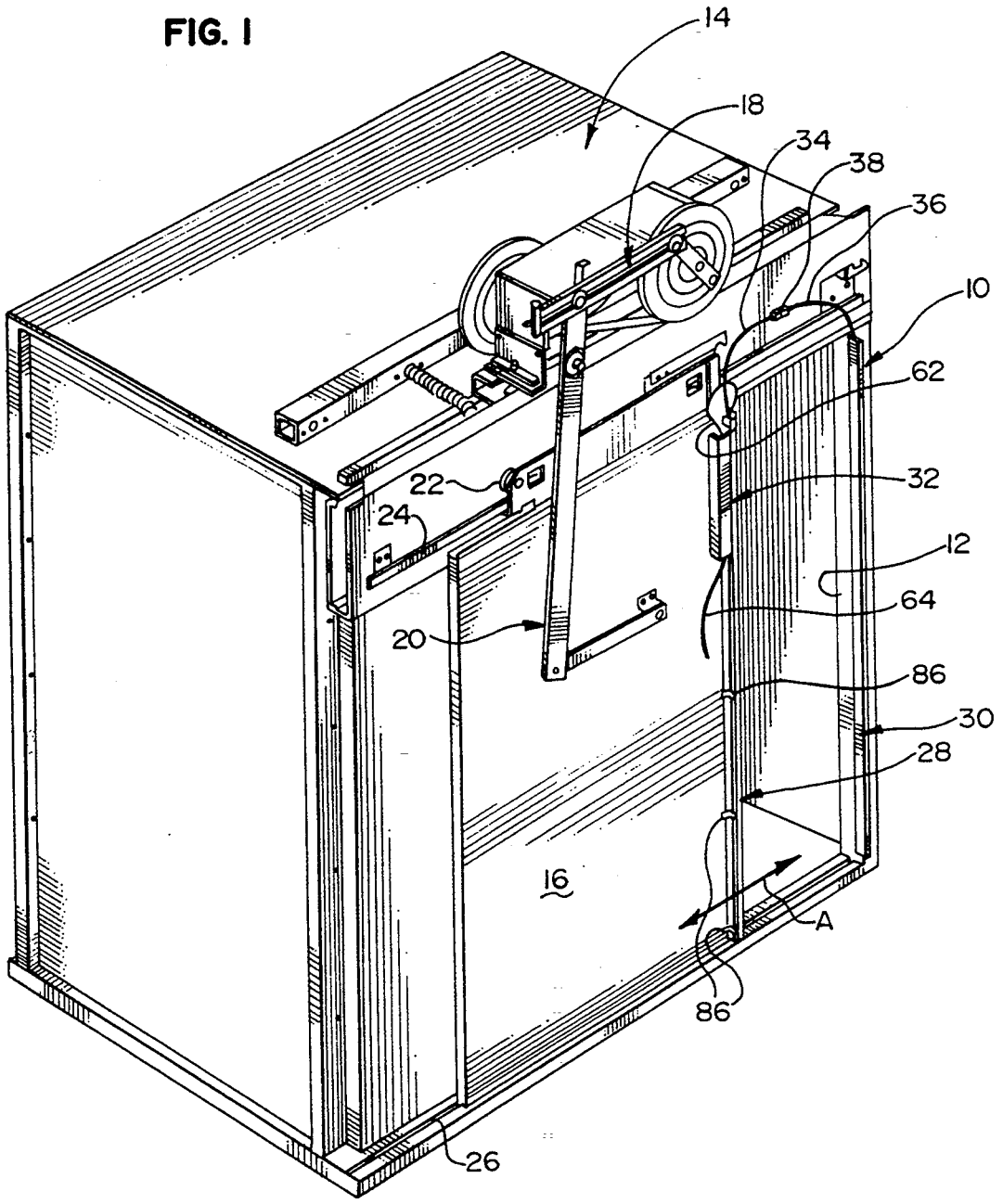
FIG. 1 is a perspective view of an elevator cab embodying the safety edge assembly of the invention.

Referring to the drawings in greater detail, and first to FIG. 1, the invention is embodied in a safety edge assembly, generally designated 10, for an electronic sensor system in a doorway 12 of an elevator cab, generally designated 14, having a slidably mounted door 16 to open and close doorway 12. The elevator cab, itself, does not form part of the invention and is shown somewhat generally, simply to include motive means, generally designated 18, coupled through linkage means, generally designated 20, for moving door 16 in the direction of double-headed arrow "A", to open and close the doorway. The door has rollers 22 for riding on an upper rail 24 fixed to the front of the elevator cab, and a guideway 26 in the floor of the elevator cab for guiding the bottom of the door. Otherwise, the elevator cab is of generally conventional construction and will not be described further herein.

Figure 2:
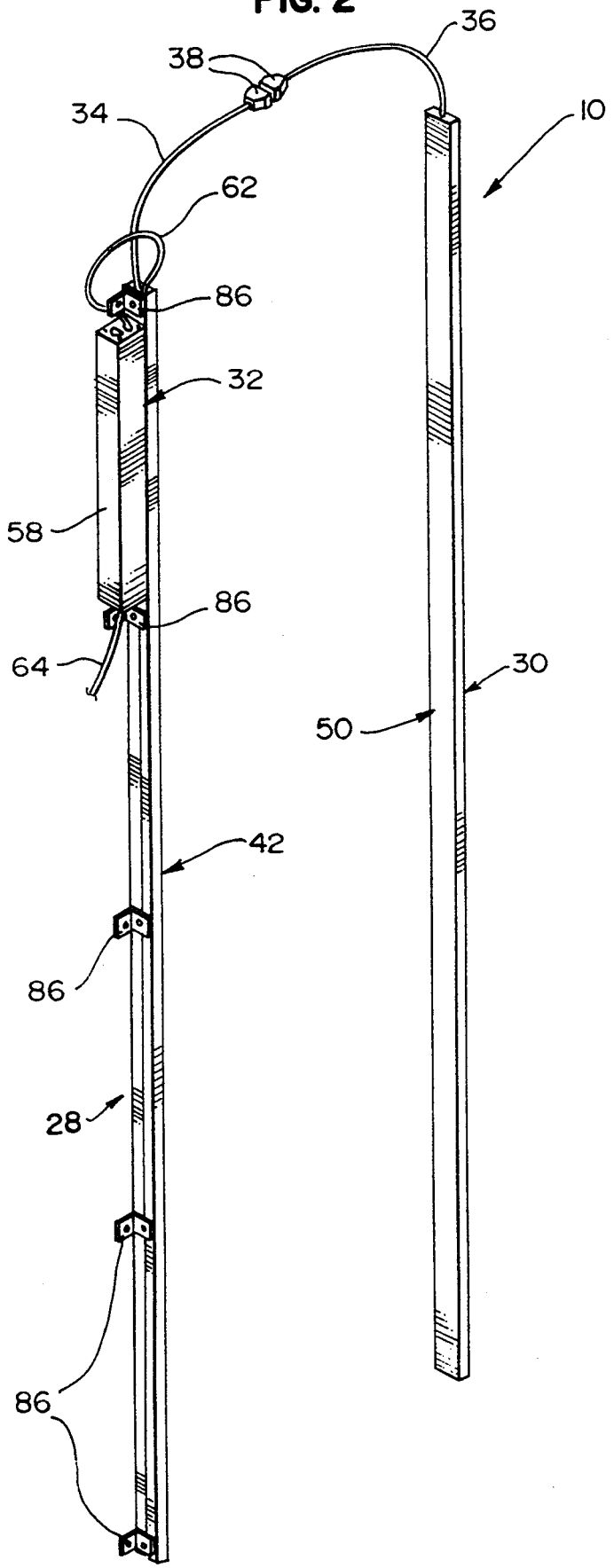
FIG. 2 is a perspective view of the basic components of the safety edge assembly as it might be mounted at a doorway of the elevator cab corresponding to the depiction in FIG. 1.

Referring to FIG. 2 in conjunction with FIG. 1, safety edge assembly 10 includes three basic components, namely: a narrow elongated transmitter frame, generally designated 28; a narrow elongated receiver frame, generally designated 30; and a power supply frame, generally designated 32. It can be seen that the power supply frame is fastened in a piggyback fashion on transmitter frame 28, as will be described in greater detail hereinafter. It also can be seen that a pair of flexible electrical cables 34 and 36 are interconnected by a pair of electrical connectors 38 between the transmitter and receiver frames and above doorway 12 (FIG. 1). Lastly, fastening means (described hereinafter) are provided for fastening the transmitter frame and the receiver frame to opposite sides of doorway 12.

Figure 3:
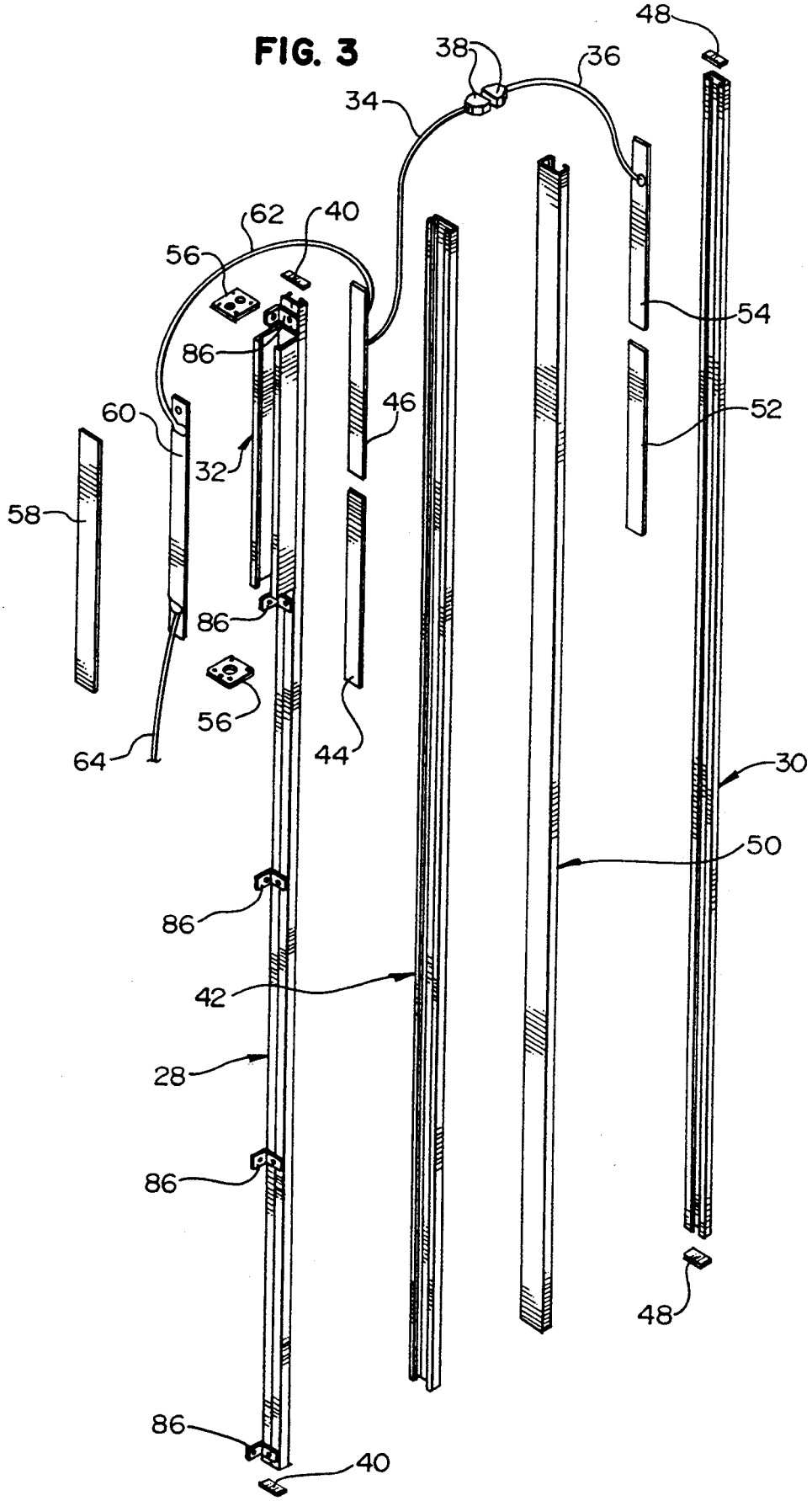
FIG. 3 is an exploded perspective view similar to that of FIG. 2, and showing additional parts of the assembly.

Referring to FIG. 3 in conjunction with FIGS. 1 and 2, narrow elongated transmitter frame 28 includes a pair of end caps 40 and a narrow elongated cover, generally designated 42, all of which combine to define an elongated cavity within the frame. A plurality of appropriate electronic transmitting components, including printed circuit boards 44 and 46, are mounted within the transmitter frame.

Similarly, receiver frame 30 includes a pair of end caps 48 and a narrow elongated cover 50, all of which combine to define a cavity therewithin for mounting appropriate electronic receiver components, such as printed circuit boards 52 and 54 therewithin. It can be seen that flexible electrical cable 34 is interconnected to circuit board 46 within transmitter frame 28, and flexible electrical cable 36 is interconnected to printed circuit board 54 within receiver frame 30.

Similarly, power supply frame 32 includes a pair of end caps 56 and an elongated cover 58 for defining an elongated cavity within the frame for housing appropriate electronic power components such as a printed circuit board 60. It can be seen that circuit board 60 is interconnected by an electrical cable 62 to circuit board 46 within transmitter frame 42. In addition, an electrical cable 64 projects from circuit board 60 and leads to an appropriate source of power (not shown).

At this point, it should be understood that the precise electronics of the electronic sensor system which may be embodied in safety edge assembly 10 does not form part of the invention and will not be described in any detail herein. Certain features of the frames may be provided specifically for mounting electronic components, such as printed circuit boards, but the circuitry itself is not part of the invention. Suffice it to say, printed circuit board 44 is a transmitter circuit board, printed circuit board 52 is a receiver circuit board, printed circuit board 54 is an amplifier circuit board, printed circuit board 46 is a microcomputer circuit board and printed circuit board 60 is a power supply circuit board.

In general, power supply circuit board 60 is connected to a conventional 120 or a 230 volt AC power source, as through cable 64, and converts high AC power to low DC power required to operate the transmitter and receiver. The power supply circuit board is directly connected to transmitter circuit board 46 through cable 62 and includes output terminals (not shown) for connection to remote equipment to indicate the status of the safety edge system. The transmitter is mounted on the elevator door, as shown. The transmitter is microprocessor controlled and includes forty infrared emitting diodes spaced lengthwise of the elongated transmitter frame. The microprocessor controls the diodes to turn each diode (as well as its respective receiver) on and off five times, seriatim from the first through the fortieth diode. This sequence is repeated sixteen times per second. The microcontroller also controls devices on the receiver frame, as follows. The receiver frame mounts on the door jamb or a second door (as described hereinafter) opposite the transmitter and includes forty infrared sensors, one for each transmitter diode. The sensors also are controlled by the transmitter microprocessor. Particularly, the microprocessor verifies that when any one of the diodes is pulsed five times, the corresponding sensor receives five optical pulses from the diode. If no light pulses are received, then the controller assumes that the light path has been broken, such as by a passenger entering or exiting the elevator cab. The receiver is connected to the transmitter board through overhead cables 34 and 36 for receiving power and providing status of each sensor to the microprocessor.

Figure 4:
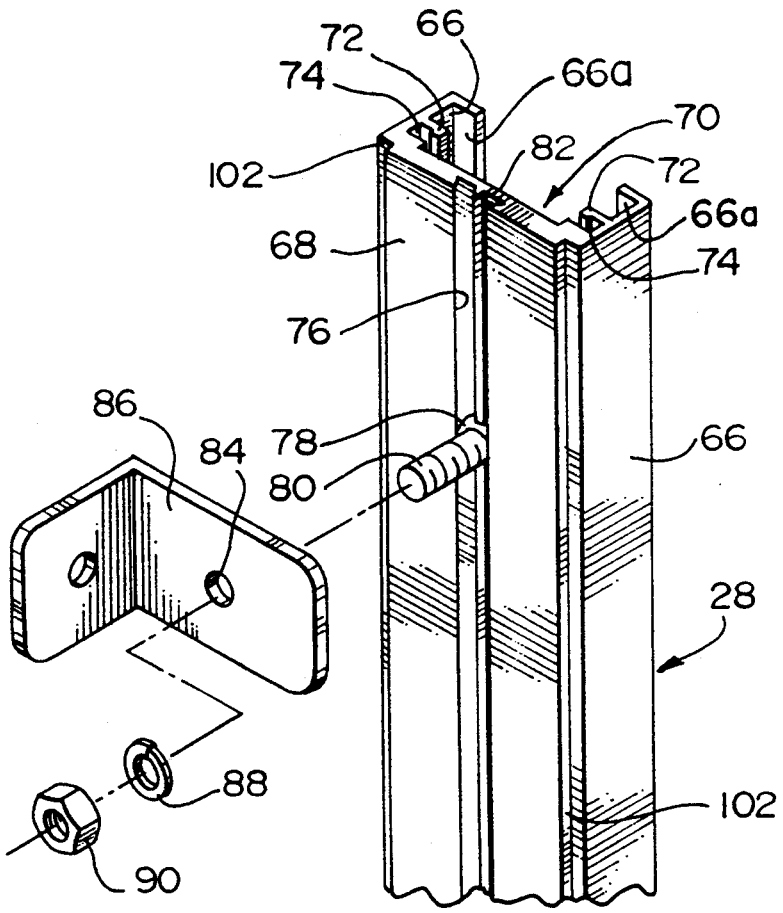
FIG. 4 is a fragmented perspective view illustrating the extruded configuration of the transmitter/receiver frames, along with the fastening means therefore and an appropriate fastening bracket.

Turning next to FIG. 4, an upper section of transmitter frame 28 is shown. According to one aspect of the invention, both transmitter frame 28 and receiver frame 30 are of identical construction or configuration and are provided by extruded members, such as of extruded aluminum, which can be cut to desired lengths for use in the system. This promotes ease of manufacture and provides very cost-effective components. More particularly, as seen best in FIG. 4, transmitter frame 28 is extruded in a channel-shaped cross configuration to define a pair of side leg portions 66 joined by a base or bight portion 68 providing a cavity, as at 70, for mounting the appropriate electronic components, as described generally above, within the cavity. Leg portions 66 have inwardly turned lips **66*a* along the lengths thereof to partially close the edges of cavity 70. Flanges 72 are integrally extruded with leg portions 66 and run the lengths of the leg portions on the insides thereof. The flanges form slots 74 longitudinally of the frame for receiving edges of printed circuit boards, such as circuit boards 44, 46, 52 and 54**, by an interference fit. Such a mounting structure allows the printed circuit boards to be mounted at any positions lengthwise of the extruded frames, and the mountings can be effected without any extraneous brackets or other fastening means whatsoever.

In order to facilitate fastening transmitter frame 28 and receiver frame 30 to the elevator door or a door jamb of the door opening, a dove-tail slot 76 is extruded integrally in the outside of bight portion 68 of frames 28 (30) for receiving the head 78 of a headed fastener such as a bolt 80 (FIG. 4). The bolt may be a conventional slotted-head fastener, and a rib 82 runs the length of slot 76 therewithin for interengagement with the slot in head 78 to prevent rotation of the bolt. The bolt may extend through a hole 84 in an L-shaped mounting bracket 86 and secured thereto by an appropriate lock washer 88 and a nut 90. Looking back at FIGS. 2 and 3, it can be seen that five mounting brackets 86 are spaced longitudinally or vertically along transmitter frame 28. Such a fastening structure allows the points of fastening to be located at any positions lengthwise of the extruded frames.

Figure 5:
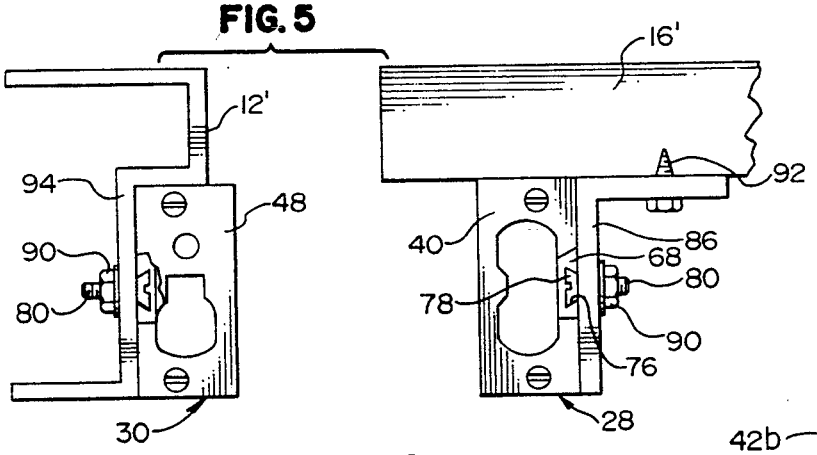
FIG. 5 is a top plan view of an arrangement for mounting the safety edge assembly in a "left-opening" door.
Figure 6:
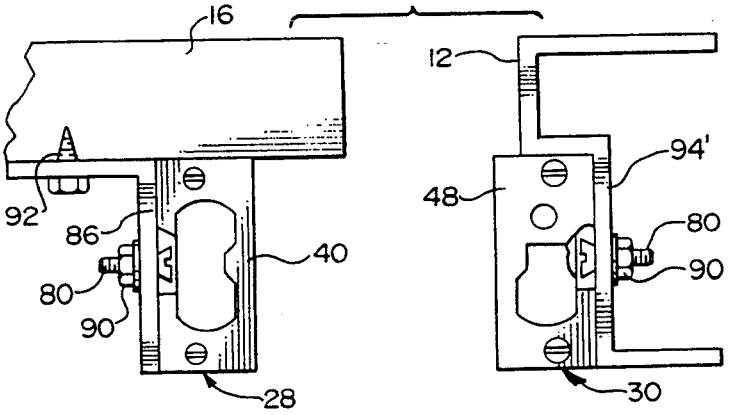
FIG. 6 is a top plan view of an arrangement for mounting the safety edge assembly in a "right-opening" door.
Figure 7:
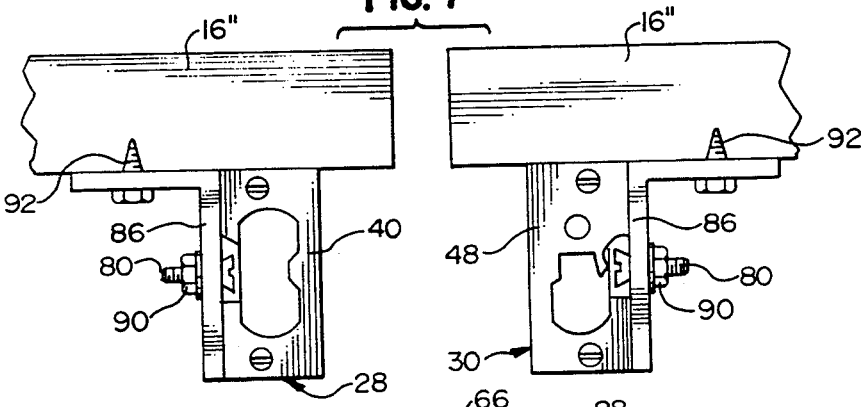
FIG. 7 is a top plan view of an arrangement for mounting the safety edge assembly in a "center-opening" door.

FIGS. 5–7 show various arrangements wherein safety edge assembly 10 is mounted within a left-opening door (FIG. 5), a right-opening door (FIG. 6) and center-opening doors (FIG. 7). More particularly, FIG. 5 shows transmitter frame 28 mounted to a right-opening door 16' by means of brackets 86 and fastening bolts 80, as described above. Screws 92, in turn, secure the brackets to the door. On the other side of a doorway 12', receiver frame 30 is fastened directly to a door jamb 94, by means of similar fasteners 80, directly opposite transmitter frame 28.

FIG. 6 shows an arrangement identical to that described above in relation to FIG. 5, except that elevator door 16 is a right-opening door as shown in FIGS. 1 and 2. Transmitter frame 28 is secured to the door by means of brackets 86, fastening bolts 80 and screws 92, as described above in relation to FIG. 5. Receiver frame 30 is fastened to a door jamb 94' by means of fasteners 80, again as described above in relation to fastening receiver frame 30 to door jamb 94 in FIG. 5.

FIG. 7 shows an arrangement wherein transmitter frame 28 and receiver frame 30 are mounted to a pair of center opening doors 16" by a plurality of brackets 86, fastening bolts 80 and screws 92. In other words, a comparison can be made generally to the right-hand portion of FIG. 5 and the left-hand portion of FIG. 6.

Figure 8:
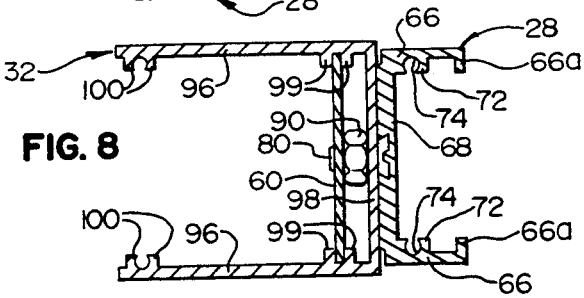
FIG. 8 is a horizontal section showing the means for fastening the power supply frame to the transmitter frame.

FIG. 8 shows how power supply frame 32 is fastened to transmitter frame 28 by the simple use of fastener bolts 80 described above in relation to FIG. 4. Again, efficiency of construction and assembly is quite apparent. The power supply frame also can be mounted at any position lengthwise of the transmitter frame to avoid interference with linkages, etc., of various door designs. In addition, FIG. 8 shows that power supply frame 32, like transmitter and receiver frames 28 and 30, respectively, is generally channel-shaped in cross-section to define a pair of side leg portions 96 joined by a bight portion 98. Like the transmitter and receiver frames, integrally extruded flanges 99 are provided to define means for edge-wise mounting printed circuit board 60. In addition, pairs of integrally extruded flanges 100 are provided on the insides of side leg portions 96, near the outer edges thereof, for edge-wise receiving cover 58 (FIG. 2).

By mounting the power supply frame to the transmitter frame at the side of the doorway, rather than above the doorway as in the prior art, high power lines above a passenger pathway are avoided. The AC power (cable 64) simply is run up to the outside of the door, and the DC line (cables 34,36) is run above the doorway.

Figure 9:
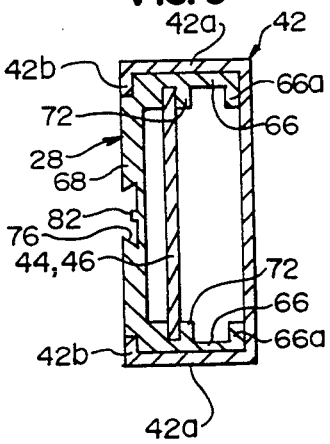
FIG. 9 is a horizontal section through the transmitter frame with the cover assembled thereabout.

Lastly, FIG. 9 shows cover 42 assembled to transmitter frame 28, with one of the printed circuit boards 44,46 therewithin. It can be seen that the cover is generally channel-shaped, with side walls **42*a* embracing the side leg portions 66 of the transmitter frame, the side walls having inwardly turned lips 42*b* for snapping into recessed areas 102 (FIG. 4) of the transmitter frame to thereby completely enclose the frame, except for the backside thereof defined by bight portion 68 which is fastened either to a door or to power supply frame 32. It should be understood that cover 50 and receiver frame 30 are constructed substantially identical to cover 42 and transmitter frame 28 described in relation to FIG. 9**. The covers are fabricated of extruded translucent material, such as polycarbonate or the like.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A safety edge assembly for an electronic sensor system in an elevator doorway, comprising:

a narrow elongated transmitter frame for mounting appropriate electronic transmitting components of the system thereon;

means for fastening the transmitter frame vertically on one side of the doorway;

a narrow elongated receiver frame for mounting appropriate electronic receiver components of the system thereon;

means for fastening the receiver frame vertically on the opposite side of the doorway;

a high power supply frame for mounting appropriate electronic power components of the system thereon and including a high power cable leading to an appropriate high power source;

means for fastening the high power supply frame in a piggyback fashion on the transmitter frame; and low power electrical cable means coupled between the electronic components on opposite sides of the doorway and extending across the top of the doorway.

2. The safety edge assembly of claim 1 wherein said electrical cable means comprise a pair of flexible electrical cables interconnected above the doorway by a pair of electrical connectors terminated to the cables.

3. The safety edge assembly of claim 1 wherein at least one of the narrow elongated transmitter and receiver frames is generally channel-shaped in cross-section to define a pair of side leg portions joined by a bight portion providing a cavity.

4. The safety edge assembly of claim 3 wherein the fastening means for said at least one of the frames comprises a dove-tail slot running lengthwise of the frame on the outside of the bight portion thereof for receiving the heads of appropriate headed fasteners.

5. The safety edge assembly of claim 3, including mounting means on the inside of the leg portions of said at least one of the frames for mounting an electronic component, such as a printed circuit board, spanning the leg portions.

6. The safety edge assembly of claim 3, wherein both the transmitter and receiver frames comprise extruded members of identical configuration and formed with said channel-shaped cross-section.

7. The safety edge assembly of claim 6 wherein said fastening means for the transmitter and receiver frames comprise a dove-tail slot running lengthwise of each frame on the outside of the bight portion thereof for receiving the heads of appropriate headed fasteners.

8. The safety edge assembly of claim 6, including mounting means on the inside of the leg portions of the transmitter and receiver frames for mounting an electronic component, such as a printed circuit board, spanning the leg portions.

9. The safety edge assembly of claim 3, including an elongated cover adapted for mounting on said at least one of the frames for closing the cavity provided thereby.

10. The safety edge assembly of claim 3 wherein said high power supply frame and said transmitter frame are generally channel-shaped with a bight portion of the high power supply frame adapted to be mounted to the bight portion of the transmitter frame.

11. The safety edge assembly of claim 10 wherein said channel-shaped power supply frame includes a pair of side leg portions having mounting means on the inside thereof for mounting an electronic component, such as a printed circuit board, spanning the leg portions.

12. In a safety edge assembly for an electronic sensor system in an elevator doorway, the assembly including a transmitter frame on one side of the doorway for mounting appropriate electronic transmitting components of the system thereon, and a receiver frame on the opposite side of the doorway for mounting appropriate electronic receiver components of the system thereon, wherein the improvement comprises:

said transmitter and receiver frames comprising narrow elongated extruded members, each frame being generally channel-shaped in cross-section to define a pair of side leg portions joined by a bight portion providing a cavity for mounting the appropriate electronic components therewithin, mounting means integral with the inside of the leg portions of the channel-shaped frames for facilitating mounting the electronic components, means on the bight portion of each frame for facilitating fastening of the frame to an appropriate support structure such as an elevator door and a door jamb, a high power supply frame for mounting appropriate electronic power components of the system thereon and including a high power cable leading to an appropriate high power source, means for fastening the high power supply frame in a piggyback fashion on the transmitter frame, and low power electrical cable means coupled between the electronic components on opposite sides of the doorway and extending across the top of the doorway.

13. In a safety edge assembly as set forth in claim 12, wherein said mounting means on the inside of the leg portions of the power supply frame are structured for selectively mounting the electronic component at any position lengthwise of the power supply frame.

14. In a safety edge assembly as set forth in claim 12, wherein said mounting means are structured for selectively mounting the electronic components at any position lengthwise of the respective frame.

* * * * *